US005915874A

United States Patent [19]

Wilson et al.

[11] Patent Number: 5,915,874

[45] Date of Patent: Jun. 29, 1999

[54] BOOK POCKET IN-FOLD ATTACHMENT

[75] Inventors: Robert B. Wilson, South Hadley; F. Christian Schweitzer, Westfield, both of Mass.

[73] Assignee: Specialty Loose Leaf, Inc., Holyoke, Mass.

[21] Appl. No.: 08/950,544

[22] Filed: Oct. 15, 1997

[51] Int. Cl.[6] ..... B42F 13/00

[52] U.S. Cl. ..... 402/79; 40/777; 283/61

[58] Field of Search ..... 402/79; 281/38; 283/61, 62; 462/19; 40/771, 774, 775, 776, 777

[56] References Cited

U.S. PATENT DOCUMENTS

| | | | |
|---|---|---|---|
| 3,565,452 | 2/1971 | Gottlieb | 402/79 |
| 5,048,869 | 9/1991 | Schwartz | 281/16 |
| 5,165,721 | 11/1992 | Schwartz | 281/15.1 |
| 5,316,341 | 5/1994 | Schwartz | 281/15.1 |
| 5,318,324 | 6/1994 | Lombardo et al. | 283/62 |
| 5,380,043 | 1/1995 | Schwartz | 281/15.1 |
| 5,405,169 | 4/1995 | Schwartz | 281/16 |
| 5,407,231 | 4/1995 | Schwartz | 281/16 |
| 5,464,255 | 11/1995 | Schildmeyer | 283/62 |
| 5,738,460 | 4/1998 | Flynn | 402/79 |

*Primary Examiner*—Willmon Fridie, Jr.
*Assistant Examiner*—Adesh Bhargava
*Attorney, Agent, or Firm*—Robert A. Seemann

[57] ABSTRACT

A panel attached to a book on foldable extensions by which the panel can be positioned next to the book and at various heights within the book and maintain the same orientation at each position, has a slot configured to receive an object through the panel and an acute fold at each end of the slot transverse to the slot at the fold, blocking the end of the slot.

5 Claims, 7 Drawing Sheets

BOOK POCKET IN-FOLD ATTACHMENT

BACKGROUND OF THE INVENTION

1. Field of the Invention

The invention relates to improvements in a pocket attachment for a book that is attached to the book at the spine of the book and which has a pocket panel that extends beyond the pages of the book and which may be laid in a first position adjacent to the book or in a second position on a page on the front of the open book with the orientation of the pocket face of the panel being the same in the first and second positions.

2. Description of the Prior Art

The prior art is replete with patents describing a pocket attachment for a loose-leaf or fixed bound book that is designed to display items such as photographs, maps or other items in which the item may be viewed adjacent to the open pages of the book or moved onto a page of the open book, say for comparison with information on the adjacent page, such as in U.S. Pat. Nos. 5,380,043; 5,048,869; 5,165,721; 5,407,231; and 5,316,341.

FIGS. 1–8 show a PRIOR ART pocket attachment being marketed that is similar to ones described in the above patents.

Referring to FIGS. 1–8, die-cut sheet 20 panel 22 includes holes 24 adapted for attaching sheet 20 to rings 26 of loose-leaf book 28, one side is shown.

A plurality of adjacent parallel folds 30, 32, 34, and 36 which are spaced from one another separate panel 22 from panel 40.

Fold 44 separates legs 48 and 50 from panel 40, the legs being spaced apart by opening 54.

Fold 56 separates legs 48 from panel 58.

Legs 48 and 50 are fastened 60 by side 66 to panel 58 side 68 by glue 62, fusing or other means. The fastening means is preferably close to fold 44, but it can extend the length of the leg.

Side 74 of panel 58 is rotated 76 around on one or both of folds 44 and a fold or folds from the group of 30 to 36, so that side 74 faces upward 80. This is preferably done after the legs are fastened to panel 58.

FIG. 4 shows side 74 rotated up and in generally the same plane as panel 22, adjacent to panel 22 which is between pages 46.

FIG. 5 shows side 74 raised above the plane of panel 22, generally parallel to panel 22 and spaced from panel 22.

FIG. 6 shows side 74 raised to a different height above panel 22, generally parallel to panel 22 and spaced from panel 22. Panel 58 is resting on top of pages 46.

FIG. 7 shows side 74 at a different height above panel 22, generally parallel to panel 22 and spaced from panel 22. Panel 58 is resting in between pages 46.

Side 74 can be moved into any of a plurality of horizontal parallel planes at any of a plurality of vertical heights while panel 22 is attached to the book, or while panel 22 is held fixed in a plane, and it can be moved over panel 22 and can be moved lateral to the top face of panel 22.

In FIG. 8, pad back board 82 is mounted on side 74 which is designed for receiving and holding the pad. Back board 82 extends through slot 84, passes behind panel 58 adjacent to side 68 and passes back to side 74 by way of slot 86. Corner 88 of board 82 extends into slot 90. In another embodiment, slot 94 may be made to receive a corner of the board which may be made to pass through one or both of slots 84 and 86.

In order to hold the board snugly, slots 84 and 86 must be held to close length tolerances because if the slot is too short in length the board will tear the slots at ends 95, 96, 97 or 98. Ends 95, 96, 97 and 98 are spaced from fold 56 and end 64 of panel 58, and are cut in a curve so that panel 58 can bow out along the slot to accommodate the thickness of the board. This does not prevent them from tearing beyond the curves at ends 95, 96, 97 or 98 either from thickness of the back board, from inserting a pen or item of additional thickness into the slot, from pulling of the pad normal to side 74, or from force or wear from cocking of the back board sideways against an end of a slot.

SUMMARY OF THE INVENTION

It is one object of the invention to provide a die-cut pocket in-fold attachment that can be manufactured to an inexpensive broad tolerance in which the pocket will not tear at the ends of the pocket opening from expansion of the opening by the bulk of inserted materials, or from force of inserted material against the ends of the slot, or from wear by papers to the ends of the slot.

A single piece of foldable material comprises a first panel, means for attaching the first panel to a book, a second panel connected to the first panel by a first fold line, a third panel connected to the second panel by a second fold line, and a fourth panel which has a first end and a second end, the third panel is fastened to the fourth panel so that the second fold line is adjacent to the fourth panel and spaced from each of the first and second ends, the fourth panel is rotatable around the second panel on the second fold line, a third acute fold and a fourth acute fold are on the fourth panel, a slot is in the fourth panel, the slot is configured to receive an object through the fourth panel and extends to the third and fourth folds so that each of the third and fourth folds is transverse to the slot at the fold and blocks the end of the slot.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
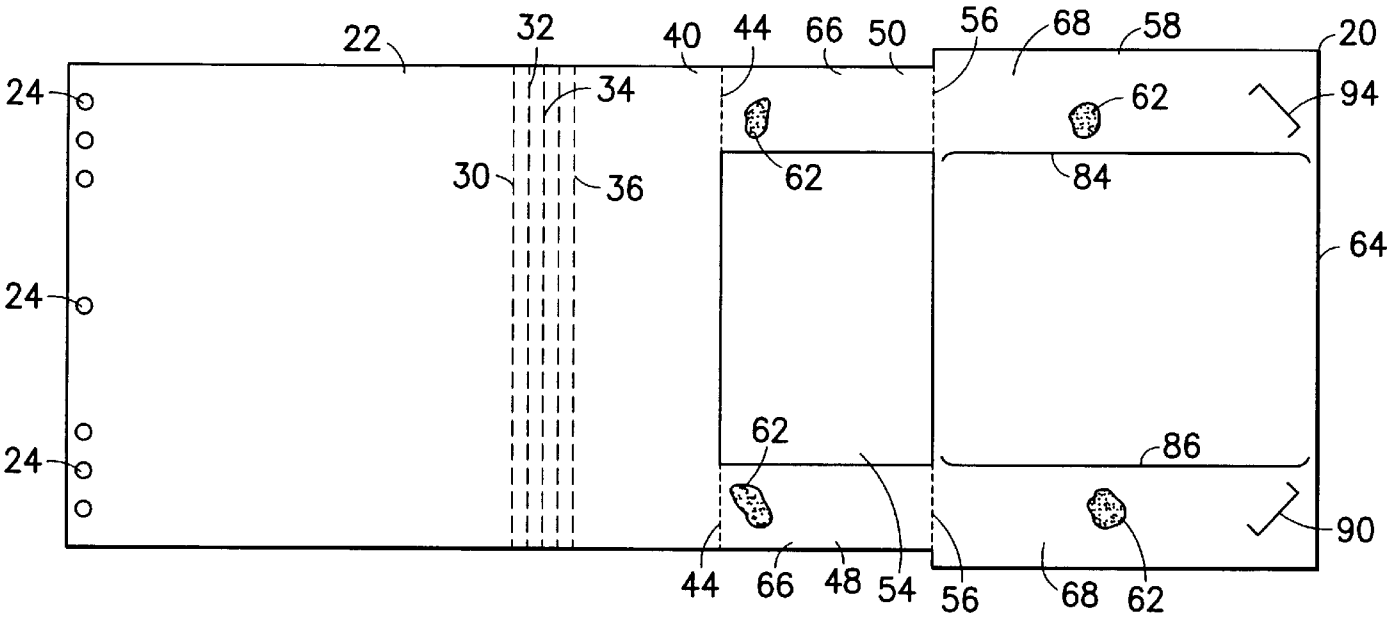
FIG. 1 PRIOR ART
FIG. 1 is a top schematic view of the front of a die-cut sheet of a PRIOR ART pocket attachment.
Figure 2:
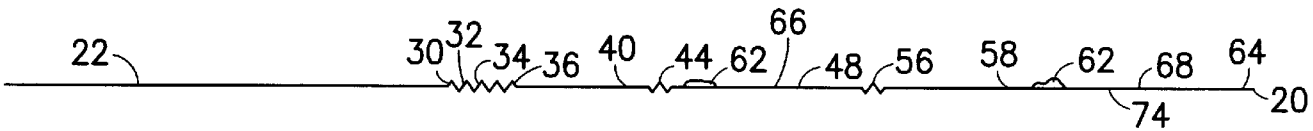
FIG. 2 PRIOR ART
FIG. 2 is a front schematic view of the PRIOR ART die-cut sheet of FIG. 1, laid flat.
Figure 3:
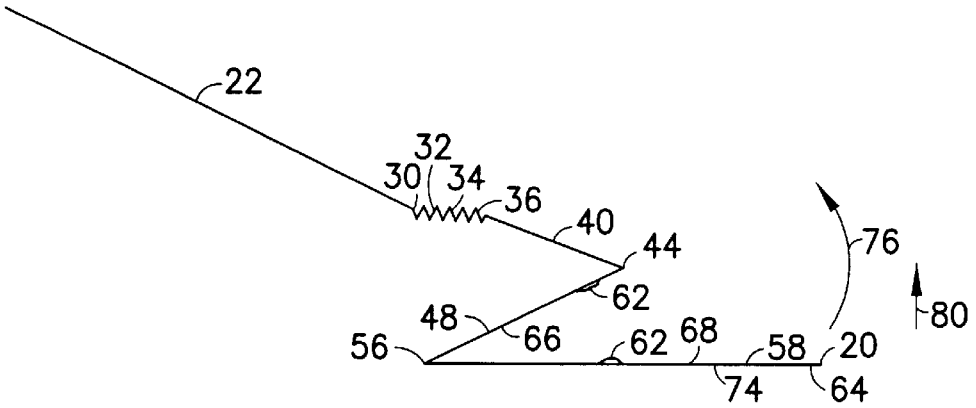
FIG.3 PRIOR ART
FIG. 3 is a front schematic view of the PRIOR ART die-cut sheet of FIG. 1 partially folded.
Figure 4:
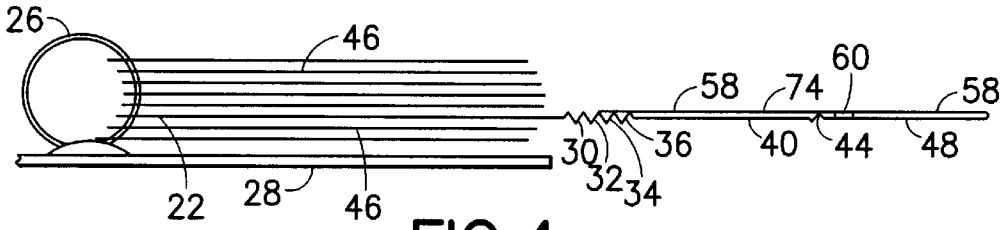
FIG.4 PRIOR ART
FIG. 4 is a front schematic view of the PRIOR ART die-cut sheet of FIG. 1, in the finished glued state, partially folded, with the pocket portion extending out from the book to which the sheet is attached.
Figure 5:
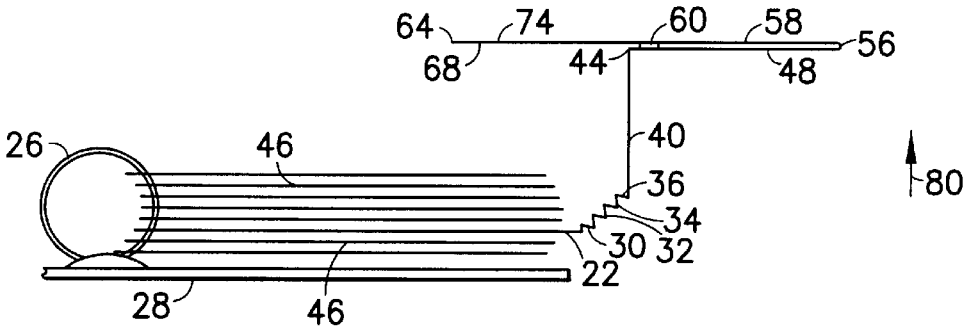
FIG.5 PRIOR ART
FIG. 5 is a front schematic view of the PRIOR ART die-cut sheet of FIG. 4, with the pocket portion raised above and parallel with the panel by which the die-cut sheet is attached to the book.
Figure 6:
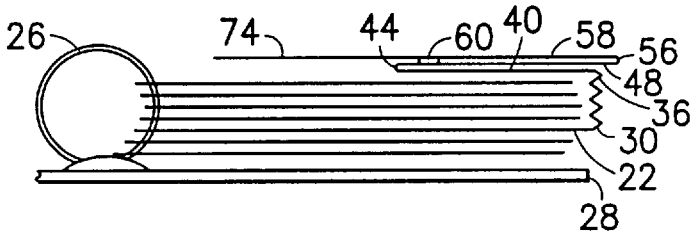
FIG.6 PRIOR ART
FIG. 6 is a front schematic view of the PRIOR ART die-cut sheet of FIG. 5, with the pocket portion at a different height above the panel, and resting on leaves of the book.
Figure 7:
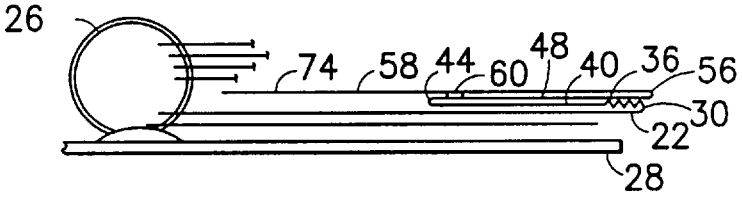
FIG.7 PRIOR ART
FIG. 7 is a front schematic view of the PRIOR ART die-cut sheet of FIG. 6, with the pocket portion at a different height above the panel, and inserted into and resting between leaves of the book.
Figure 8:
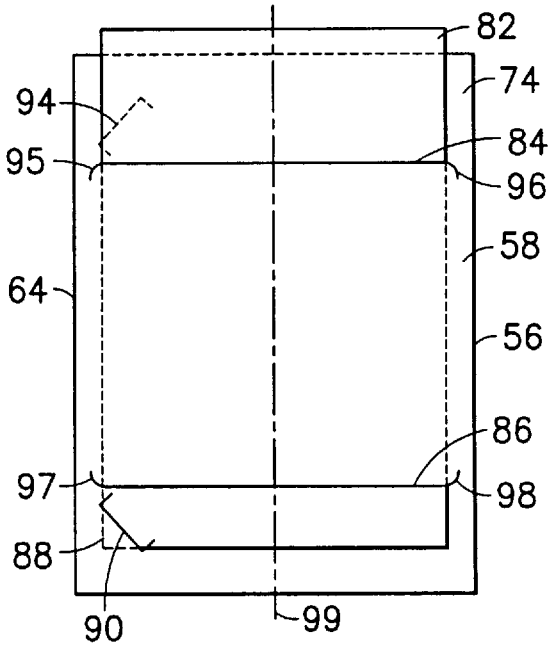
FIG.8 PRIOR ART
FIG. 8 is a top schematic view of the pocket holding a pad backing on the back of the PRIOR ART die-cut sheet.
Figure 9:
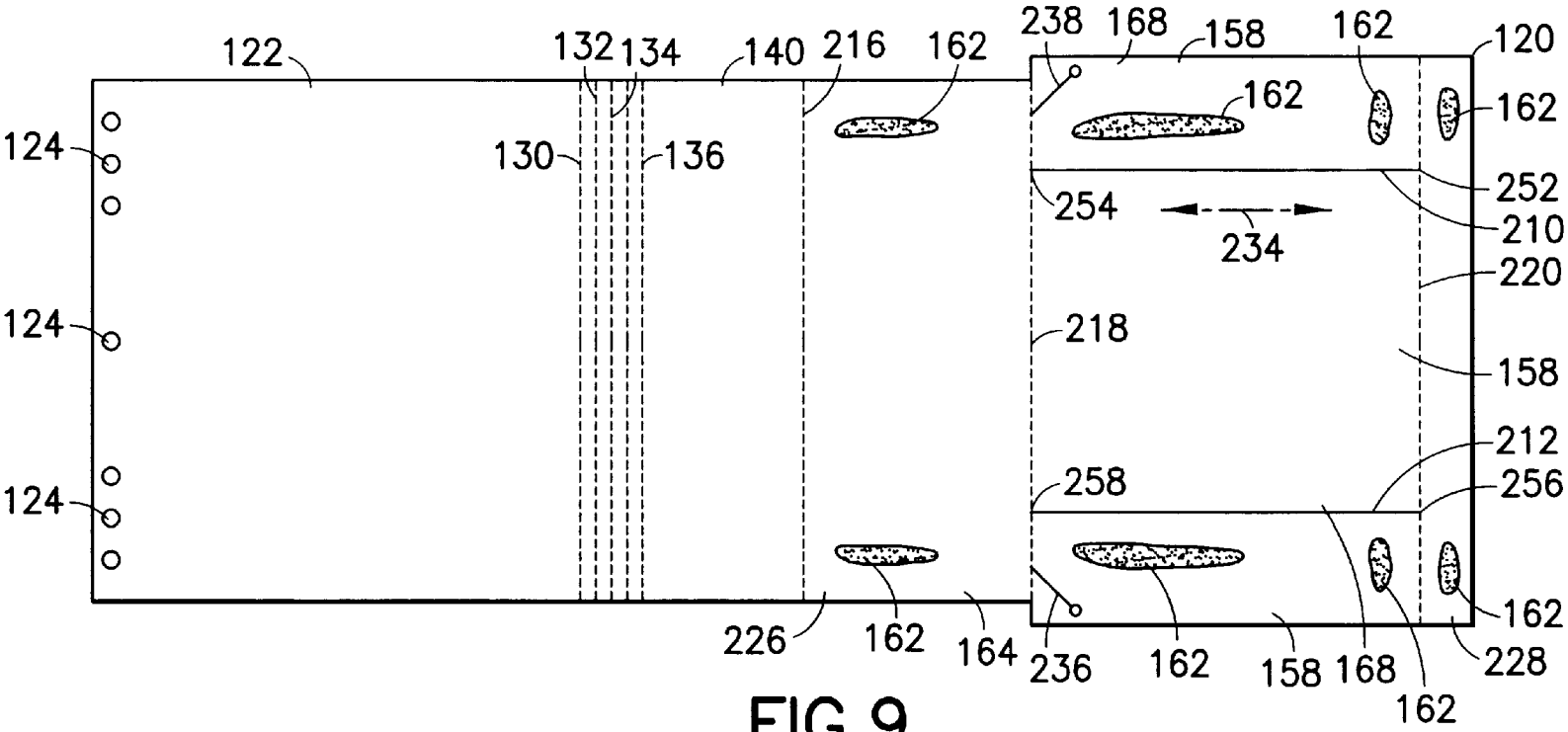
FIG. 9 is a top schematic view of the front of a die-cut sheet of the invention.
Figure 10:
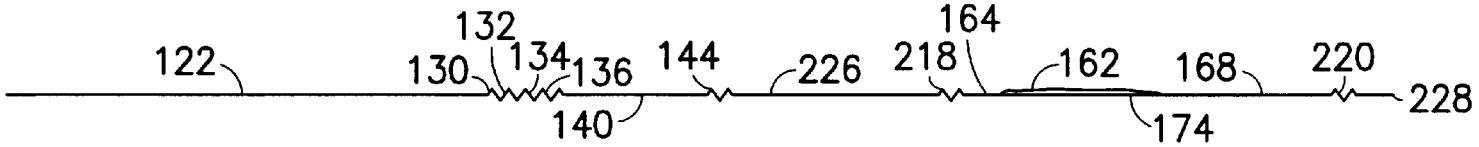
FIG. 10 is a front schematic view of the die-cut sheet of FIG. 9, laid flat.
Figure 11:
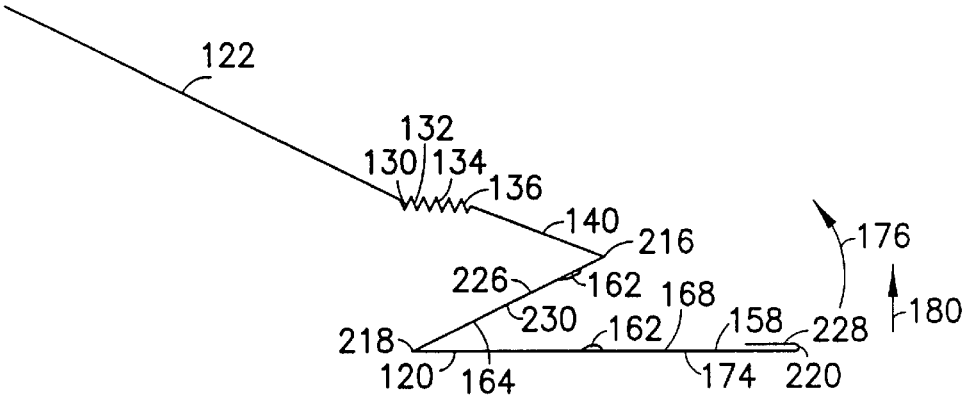
FIG. 11 is a front schematic view of the die-cut sheet of FIG. 9 partially folded.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 9–16 of the invention, die-cut sheet 120 panel 122 includes fastening means for attaching sheet 120 to a book. The fastening means shown are holes 124 adapted for attaching sheet 120 to rings 126 of loose-leaf book 128, one side of the book is shown.

A plurality of adjacent parallel folds 130, 132, 134, and 136 which are spaced from one another separate panel 122 from panel 140.

Fold 216 separates panel 226 from panel 140.

Fold 218 separates panel 226 from panel 158.

Panel 226 is fastened 160 by side 164 to panel 158 side 168 by glue 162, fusing or other fastening means. The fastening means is preferably close to fold 216, but it can extend the length of panel 226.

Side 174 of panel 158 is rotated 176 around on one or both of folds 216 and a fold or folds from the group of 130 to 136, so that side 174 faces upward 180.

Figure 12:
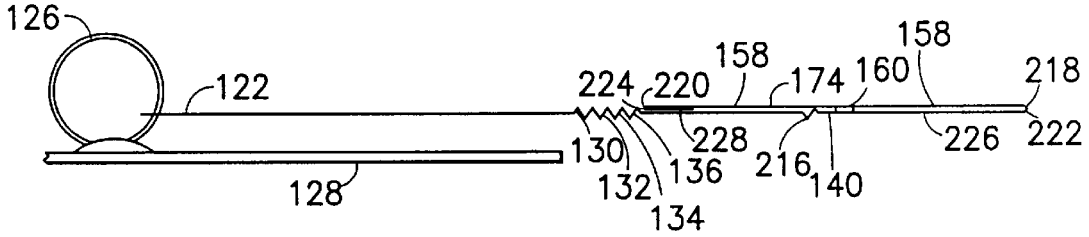
FIG. 12 is a front schematic view of the die-cut sheet of FIG. 9, in the finished glued state, partially folded, with the pocket portion extending out from the book to which the sheet is attached.

FIG. 12 shows side 174 rotated up and in generally the same plane as panel 122, adjacent to panel 122.

Figure 13:
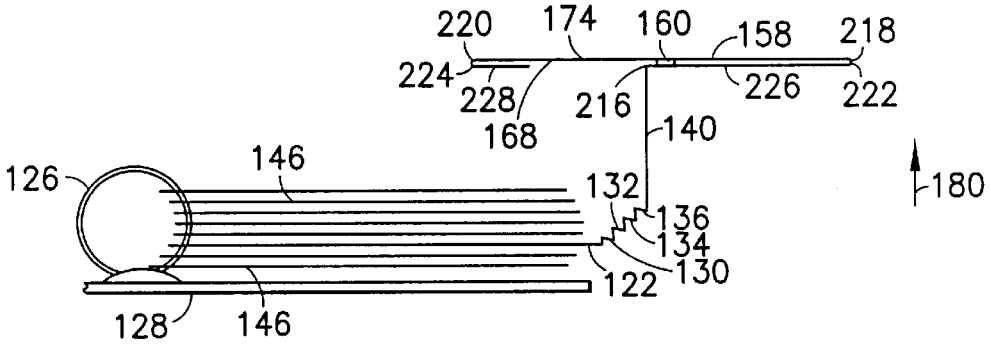
FIG. 13 is a front schematic view of the die-cut sheet of FIG. 12, with the pocket portion raised above and parallel with the panel by which the die-cut sheet is attached to the book.

FIG. 13 shows side 174 raised above the plane of panel 122, generally parallel to panel 122 and spaced from panel 122 which is between pages 146.

Figure 14:
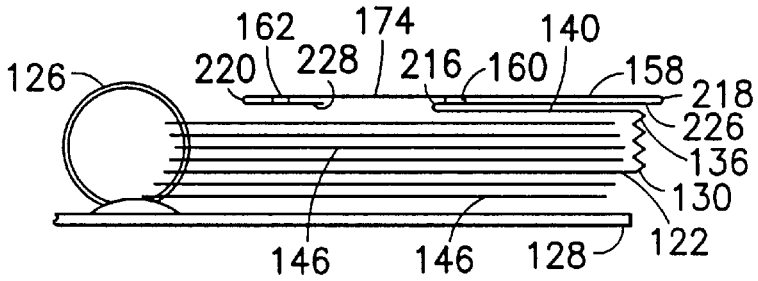
FIG. 14 is a front schematic view of the die-cut sheet of FIG. 13, with the pocket portion at a different height above the panel, and resting on leaves of the book.

FIG. 14 shows side 174 raised to a different height above panel 122, generally parallel to panel 122 and spaced from panel 122. Panels 158 and 228 are resting on top of pages 146.

Figure 15:
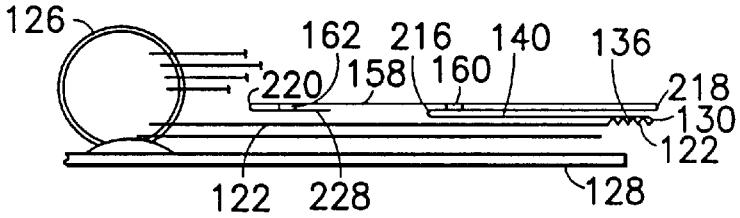
FIG. 15 is a front schematic view of the die-cut sheet of FIG. 14, with the pocket portion at a different height above the panel, and inserted into and resting between leaves of the book.

FIG. 15 shows side 174 at a different height above panel 122, generally parallel to panel 122 and spaced from panel 122. Panels 158 and 228 are between pages 146.

Side 174 can be moved into any of a plurality of horizontal parallel planes at any of a plurality of vertical heights while panel 122 is attached to the book, or while panel 122 is held fixed in a plane, and it can be moved over panel 122 and can be moved lateral to panel 122 with preservation of orientation of side 174 in each of the positions. It can be moved into any of two substantially coplanar, non-overlapping and adjacent positions on either side of one of folds 130, 132, 134, and 136 with preservation of orientation of side 174 in each of the positions.

Figure 16:
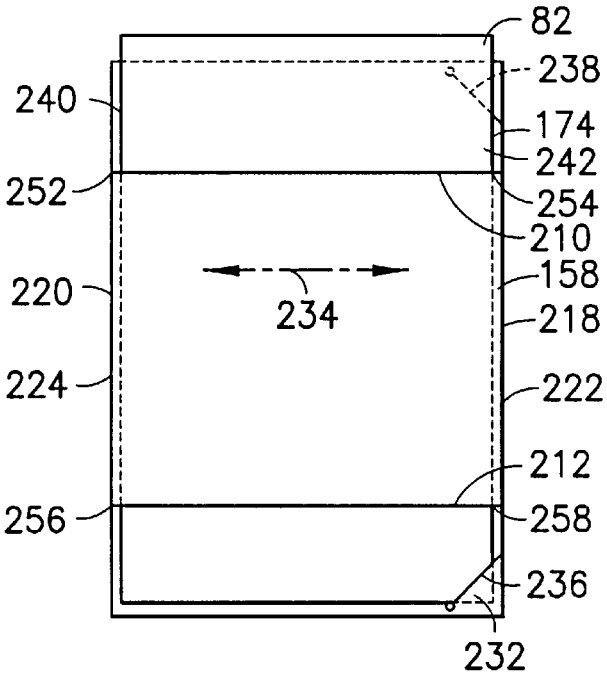
FIG. 16 is a top schematic view of the pocket holding a pad backing on the back of the die-cut sheet.

In FIG. 16, pad back board 82 is mounted on side 174 which is designed for receiving and holding the pad. Back board 82 extends through slot 210, passes behind panel 158 adjacent to side 168 and passes back to side 174 by way of slot 212. Corner 232 of board 82 extends into slot 236. In another embodiment, slot 238 may be made to receive a corner of the board which may be made to pass through one or both of slots 210 and 212.

Folds 218 and 220 are configured on the die cut sheet so that they are in close juxtaposition to edges 240 and 242 of back board 82. This prevents slots 210 and 212 from tearing beyond ends 252, 254, 256 or 258 of the slots from force of the thickness of the back board or other object in the slots bowing the slot opening normal to panel 158, from an item pressing against an end of a slot, or from wear by an item against an end of the slot.

Die cut sheet 120 is folded through acute angles on fold lines 218 and 220 in which panel 226 and panel 228 are folded and fastened to panel 158. Folds 218 and 220 close and seal ends 252, 254, 256 and 258 of slots 210 and 212.

Acute fold 218 forms side wall 222 that blocks end 254 of slot 210 transverse to the length 234 of the slot and prevents objects in the pocket slot from moving longitudinally past end 254 of the slot and tearing the end of the slot longitudinally.

Acute fold 220 forms side wall 224 that blocks end 252 of slot 210 transverse to the length 234 of the slot and prevents objects in the pocket slot from moving longitudinally past end 252 of the slot and tearing the end of the slot longitudinally.

Folds 218 and 220 side walls 222 and 224 respectively intersect the ends of slot 210 transverse to the length of the slot and prevent longitudinal ripping of the slot beyond the ends of the slot. Slots 210 and 212 go to folds 218 and 220 and stop at the folds. It should be understood that in going to a fold the slit may pass through the fold line without destroying the blocking feature of side walls 222 and 224.

The slot which goes to the folds by the above description can be designed to fit the pad back board tightly slidingly without failure of the slot ends.

Slot 212 also goes to folds 218 and 220 and is closed by lateral side walls 222 and 224 as described above in slot 210, which prevent longitudinal tear of the slot.

Although FIG. 15 shows folds 218 and 220 being preferably less than 90 degrees, an angle of 90 degrees or less is acceptable for operation of the present invention.

Figure 17:
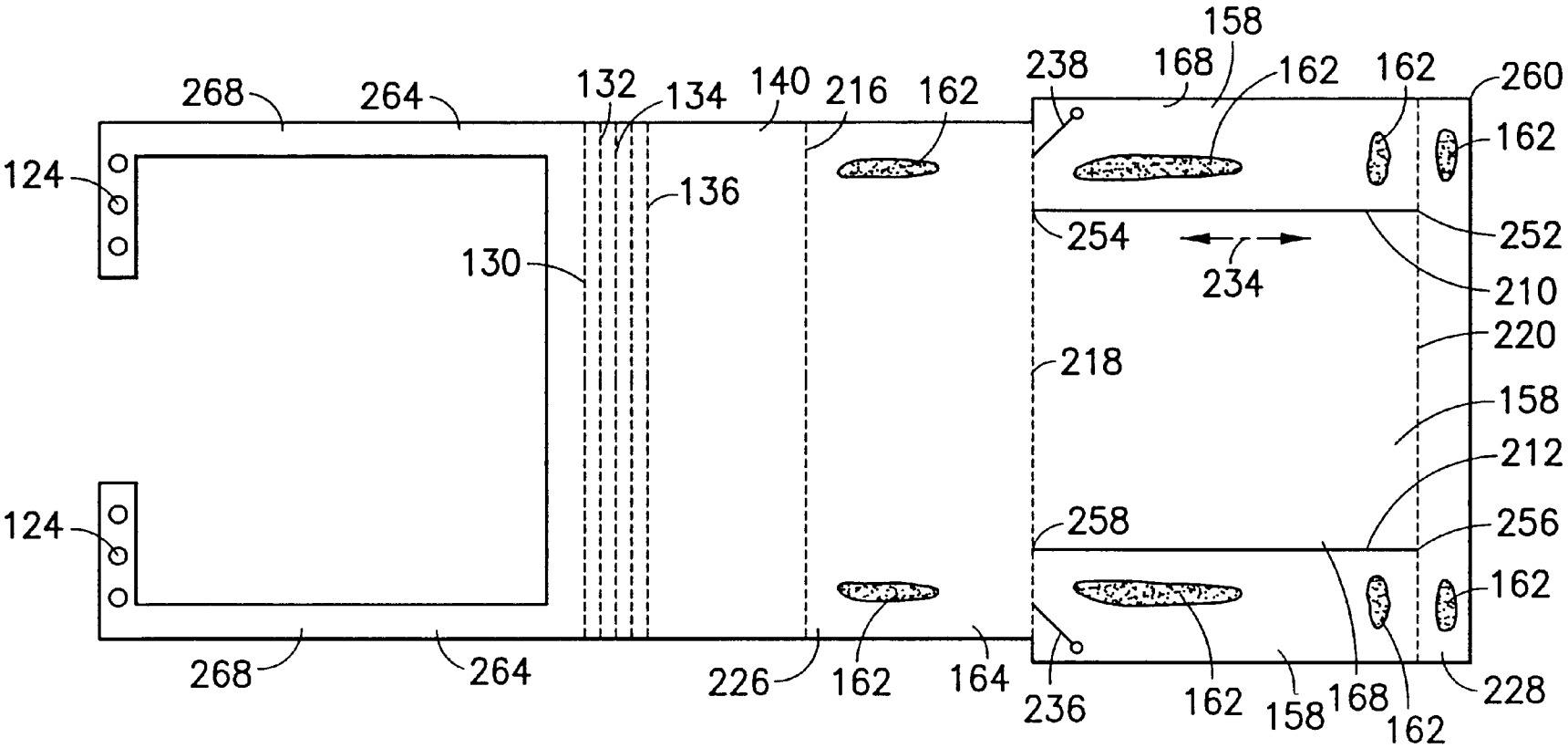
FIG. 17 is a top schematic view of the front of a sheet of the invention.

In FIG. 17, panel 264 of sheet 260 comprises extension arms 266, 268, fastening means 124 and fold 130.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A pocket attachment for a book, comprising a sheet comprising a first panel, means for attaching said first panel to a book, a second panel connected to said first panel by a first fold line on said sheet, a third panel connected to said second panel by a second fold line on said sheet, a fourth panel having a first end and a second end, said third panel being fastened to said fourth panel so that said second fold line is adjacent to said fourth panel and spaced from each of said first and second ends, said fourth panel being rotatable around said second panel on said second fold line, a third fold and a fourth fold on said fourth panel, a slot in said fourth panel, said slot having a length, being configured for receiving an object through said fourth panel and extending to said third and fourth folds so that each of said third and fourth folds is transverse to said slot at the fold.

2. The pocket attachment of claim 1, further comprising:

said third and fourth folds forming side walls that block the ends of the slots.

3. The pocket attachment of claim 1, further comprising:

said third and fourth folds each being an acute fold.

4. A pocket attachment formed as an integral unit from a single piece of foldable material, comprising a first panel, means for attaching said first panel to a book, a second panel connected to said first panel by a first fold line, a third panel connected to said second panel by a second fold line, a fourth panel having a first end and a second end, said third panel being fastened to said fourth panel so that said second fold line is adjacent to said fourth panel and spaced from each of said first and second ends, said fourth panel being rotatable around said second panel on said second fold line, a third acute fold and a fourth acute fold on said fourth panel, a slot in said fourth panel, said slot having a length, being configured for receiving an object through said fourth panel and extending to said third and fourth folds so that each of said third and fourth folds is transverse to said slot at the fold and blocks the end of the slot.

5. In a pocket attachment formed as an integral unit from a single piece of foldable material, comprising a first panel, means for attaching said first panel to a book, a second panel connected to said first panel by a first fold line, a third panel connected to said second panel by a second fold line, a fourth panel connected to said third panel by a third fold line, said fourth panel having a first end and a second end, said third panel being fastened to said fourth panel so that said second fold line is adjacent to said fourth panel and spaced from each of said first and second ends, said fourth panel being rotatable around said second panel on said second fold line, the improvement comprising a fourth fold line on said fourth panel, a slot in said fourth panel, said slot having a length, being configured for receiving an object through said fourth panel and extending to said third and fourth folds so that each of said third and fourth folds is transverse to said slot at the fold and blocks the end of the slot.

* * * * *